US011475806B2

(12) United States Patent
Coates

(10) Patent No.: US 11,475,806 B2
(45) Date of Patent: Oct. 18, 2022

(54) ASSEMBLY AND METHOD FOR ROTATABLY SECURING AN OBJECT TO A FIXTURE

(71) Applicant: Daniel Jay Coates, Ogden Dunes, IN (US)

(72) Inventor: Daniel Jay Coates, Ogden Dunes, IN (US)

( * ) Notice: Subject to any disclaimer, the term of this patent is extended or adjusted under 35 U.S.C. 154(b) by 623 days.

(21) Appl. No.: 16/294,763

(22) Filed: Mar. 6, 2019

(65) Prior Publication Data

US 2020/0258433 A1 Aug. 13, 2020

Related U.S. Application Data

(60) Provisional application No. 62/639,351, filed on Mar. 6, 2018.

(51) Int. Cl.
*G09F 17/00* (2006.01)

(52) U.S. Cl.
CPC ..... *G09F 17/00* (2013.01); *G09F 2017/0058* (2013.01)

(58) Field of Classification Search
CPC ..... G09F 17/00; G09F 2017/0058
See application file for complete search history.

(56) References Cited

U.S. PATENT DOCUMENTS 829,064 A * 8/1906 Elder et al. ..... G09F 7/20 40/607.04
1,062,850 A * 5/1913 Pratt ..... G09F 17/00 116/174
1,855,824 A * 4/1932 Crichton ..... E04H 12/32 116/173
2,672,118 A * 3/1954 Martin ..... E04H 12/32 116/174
2,711,712 A * 6/1955 Reed, Jr. ..... E04H 12/32 116/174
2,799,240 A * 7/1957 Andrews ..... E04H 12/32 D11/166
3,732,845 A * 5/1973 Istre ..... G09F 17/00 116/173
4,603,652 A * 8/1986 Thibault ..... G09F 17/00 116/174
4,930,436 A * 6/1990 Newman ..... G01P 13/02 73/170.05
D370,623 S * 6/1996 Wenger ..... D8/367
(Continued)

*Primary Examiner* — Nimeshkumar D Patel
*Assistant Examiner* — Tania Courson
(74) *Attorney, Agent, or Firm* — Hartman Global IP Law; Gary M. Hartman; Domenica N. S. Hartman

(57) ABSTRACT

A clamp assembly is provided that includes a body member having a cavity therethrough configured to receive a fixture. The cavity has a longitudinal axis through a center thereof. The body has a clamping portion configured to apply a compressive force to the fixture and thereby releasably secure the body member to the fixture. A ring member is secured to the body member in a manner such that the ring member is capable of 360-degree rotation about the longitudinal axis of the cavity of the body member while the body member remains in a fixed position. The ring member has a flange extending outwardly from a side thereof and the flange has a through hole with a central axis that is perpendicular to the longitudinal axis of the body member.

18 Claims, 11 Drawing Sheets

(56) References Cited

U.S. PATENT DOCUMENTS

| | | | | |
|---|---|---|---|---|
| 5,522,342 | A * | 6/1996 | Chen-Chao | G09F 17/00 116/174 |
| 6,845,730 | B2 * | 1/2005 | Cardarelli | G09F 17/00 116/173 |
| 6,923,141 | B1 * | 8/2005 | Staats | G09F 17/00 116/173 |
| 6,976,447 | B2 * | 12/2005 | Spiegel | G09F 17/00 116/28 R |
| 7,575,209 | B1 * | 8/2009 | Wiese | E04H 12/32 248/539 |
| D645,781 | S * | 9/2011 | Graber | D11/181 |
| 8,069,811 | B2 * | 12/2011 | Ciaccia | G09F 17/00 116/173 |
| 8,967,072 | B2 * | 3/2015 | Chen | E04H 12/32 116/173 |
| 8,973,517 | B1 * | 3/2015 | Bort | G09F 17/00 362/183 |
| 9,361,815 | B1 * | 6/2016 | Worsham | G09F 17/00 |
| D929,896 | S * | 9/2021 | Zheng | D11/182 |
| 2003/0192467 | A1 * | 10/2003 | Paris | G09F 17/00 116/173 |
| 2005/0199176 | A1 * | 9/2005 | Orton | G09F 17/00 116/174 |
| 2005/0235902 | A1 | 10/2005 | Evans | |
| 2010/0101479 | A1 * | 4/2010 | Grahl | E04H 12/32 116/173 |
| 2011/0162575 | A1 * | 7/2011 | Jahnz | G09F 17/00 248/219.4 |
| 2017/0270837 | A1 | 9/2017 | Lyons | |
| 2019/0251880 | A1 * | 8/2019 | Klevana | G09F 17/00 |

* cited by examiner (Section A-A)

(Section B-B)

(Section C-C)

ASSEMBLY AND METHOD FOR ROTATABLY SECURING AN OBJECT TO A FIXTURE

CROSS REFERENCE TO RELATED APPLICATIONS

This application claims the benefit of U.S. Provisional Application No. 62/639,351, filed Mar. 6, 2018, the contents of which are incorporated herein by reference.

BACKGROUND OF THE INVENTION

The present invention generally relates to clamping devices. The invention particularly relates to clamping assemblies configured to secure an object to a fixture while providing the object with the capability of rotating entirely around the fixture.

A wide variety of clamping devices are commercially available for securing objects to fixtures, as a nonlimiting example, a flag to a flag pole. However, these devices may suffer from several shortcomings. For example, the clamping devices may be configured to be secured to an elongated fixture of a specific size, cross-sectional shape, taper, etc., or may otherwise be limited in their ability to be securely fastened to fixtures of various sizes, cross-sectional shapes, tapers, etc. In addition, these devices often secure the object to the fixture in a fixed position with limited range of rotational motion between the object and the fixture.

In view of the above, it can be appreciated that it would be desirable if an improved clamping device were available for securing an object to fixtures of various sizes, cross-sectional shapes, tapers, etc., and capable of providing for at least some range of rotational motion between the object and the fixture.

BRIEF DESCRIPTION OF THE INVENTION

The present invention provides a clamp assembly suitable for securing an object to a fixture and allowing the object to rotate 360 degrees about the fixture.

According to one nonlimiting aspect of the invention, a clamp assembly includes a body member having a cavity therethrough configured to receive a fixture. The cavity has a longitudinal axis through a center thereof. The body has a clamping portion configured to apply a compressive force to the fixture and thereby releasably secure the body member to the fixture. A ring member is secured to the body member in a manner such that the ring member is capable of 360-degree rotation about the longitudinal axis of the cavity of the body member while the body member remains in a fixed position. The ring member has a flange extending outwardly from a side thereof and the flange has a through hole with a central axis that is perpendicular to the longitudinal axis of the body member.

Other nonlimiting aspects of the invention include methods of assembling and using the clamp assembly described above, for example, by locating the fixture through the cavity of the body member, threading the nut along the shank of and toward the head of the screw such that the flanges of the clamping portion move toward one another until the clamping portion applies a compressive clamping force to the fixture sufficient to retain the clamp assembly in a fixed position on the fixture, and securing an object to the hole in the flange of the ring member such that the object is secured to the fixture and capable of rotating 360 degrees about a longitudinal axis of the fixture.

Technical effects of the clamp assembly described above preferably include the capability of securing an object to a fixture in a manner that allows the object to have a 360-degree freedom of rotation about the fixture.

Other aspects and advantages of this invention will be appreciated from the following detailed description.

DETAILED DESCRIPTION OF THE INVENTION

Figure 1:
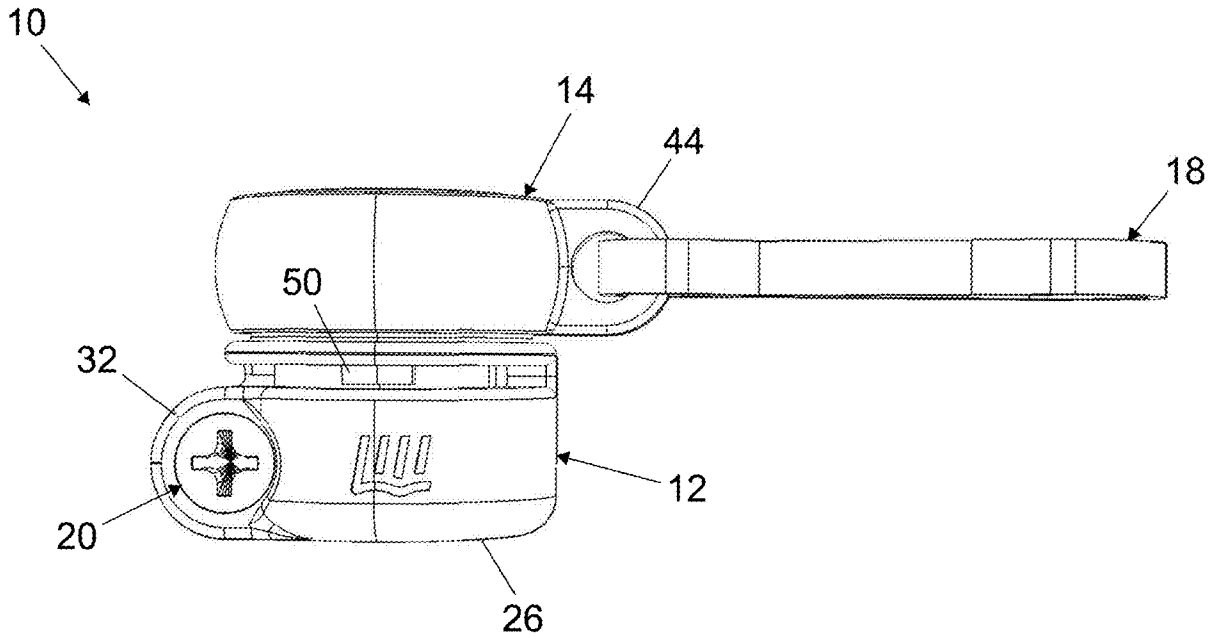
FIG. 1 is a side view of a clamp assembly in accordance with certain nonlimiting aspects of the invention.
Figure 2:
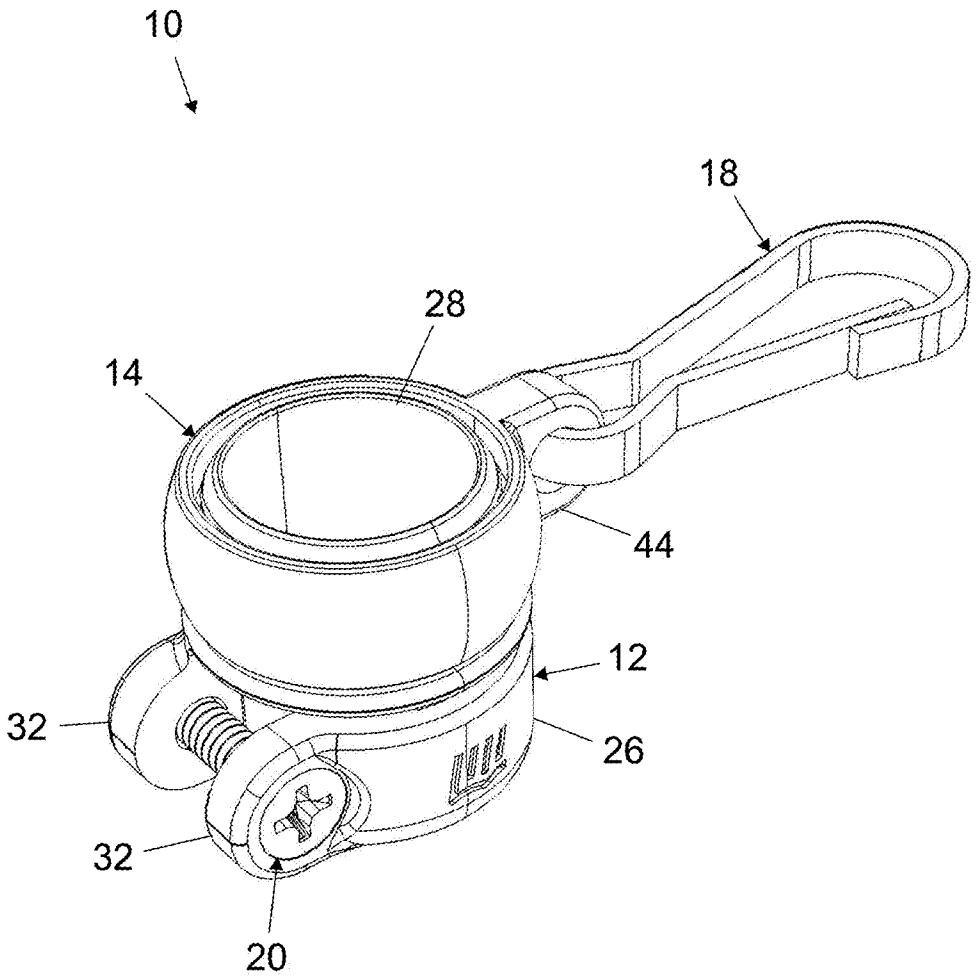
FIGS. 2 and 3 are upper and lower perspective views of the clamp assembly of FIG. 1.
Figure 3:
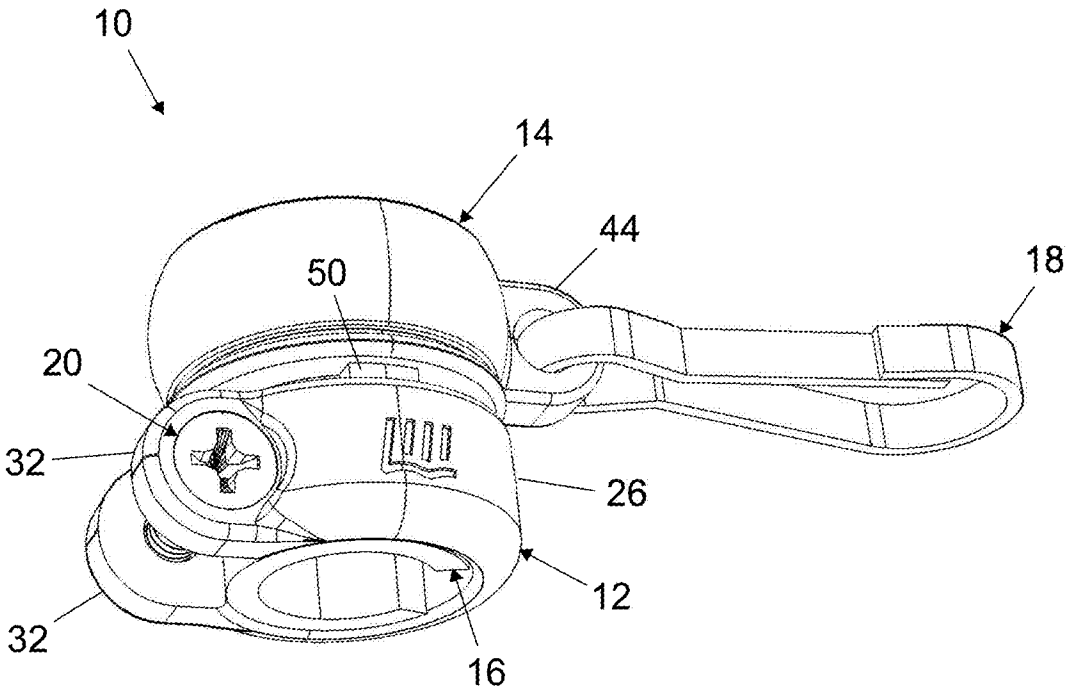
Figure 4:
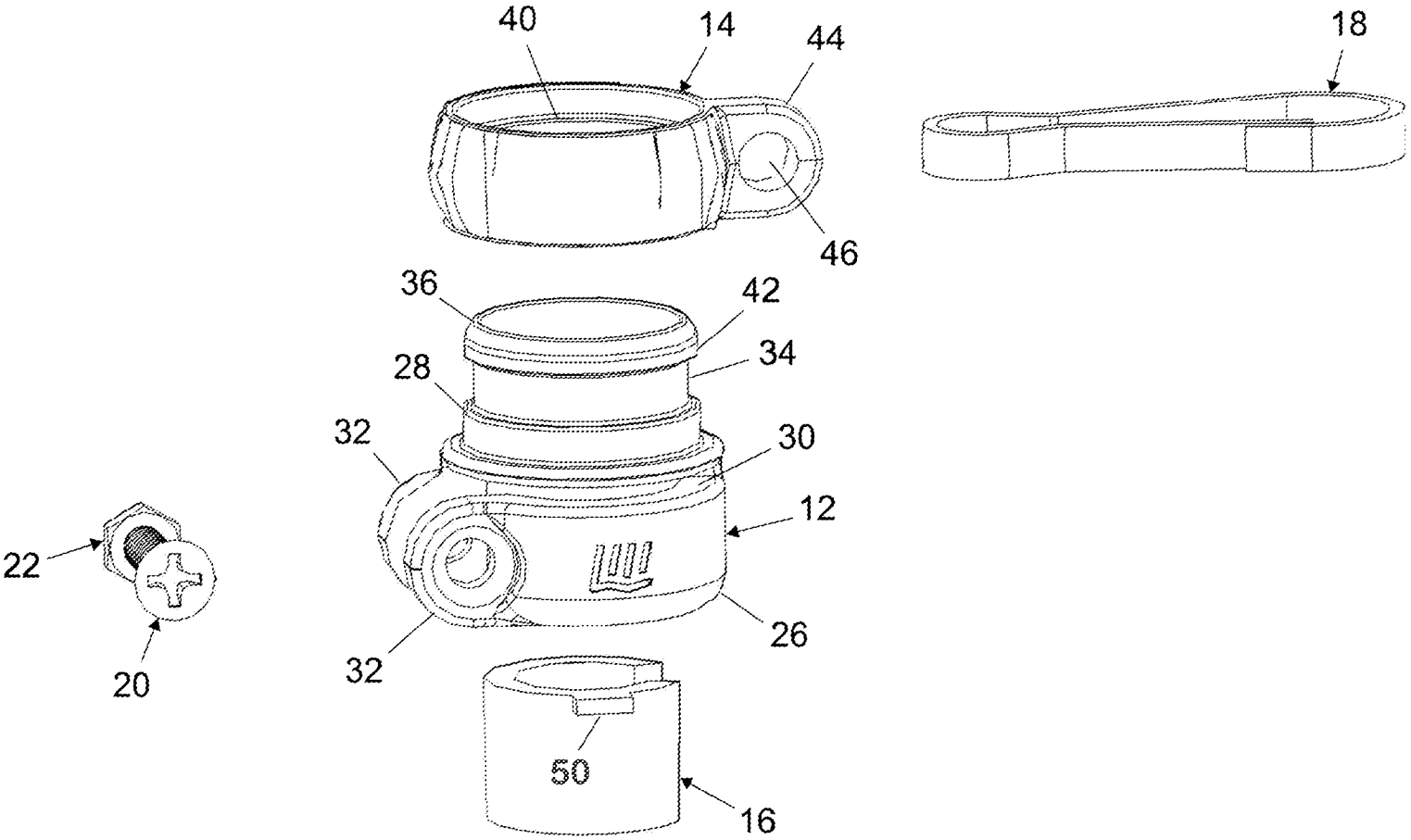
FIG. 4 is an exploded view representing components of the clamp assembly of FIG. 1.
Figure 18:
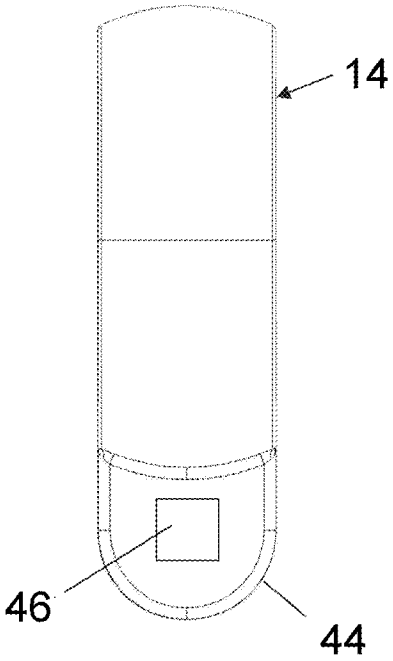

FIGS. 1 through 3 represent a nonlimiting embodiment of a clamp assembly 10 configured to be releasably secured to fixtures having cylindrical shapes and round cross-sections, such as but not limited to tubes, pipes, rods, antennae, and wires. However, it should be noted that the clamp assembly 10 depicted in FIGS. 1 through 3 may also be used or configured for use with fixtures having various lengths and various other shapes, cross-sections, and tapers. While a wide range of applications is foreseeable, the clamp assembly 10 is believed to be particularly well suited for securing objects such as (but not limited to) ropes, flags, banners, and ribbons to fixtures. For example, one or more assemblies 10 may be used to secure a flag 100 to a flag pole 110, as represented in FIG. 18. FIGS. 4 through 15 represent multiple views of certain components of the clamp assembly 10, including a body member 12, a ring member 14, an insert 16, a screw 20, a nut 22, and optionally a clip 18.

Figure 6:
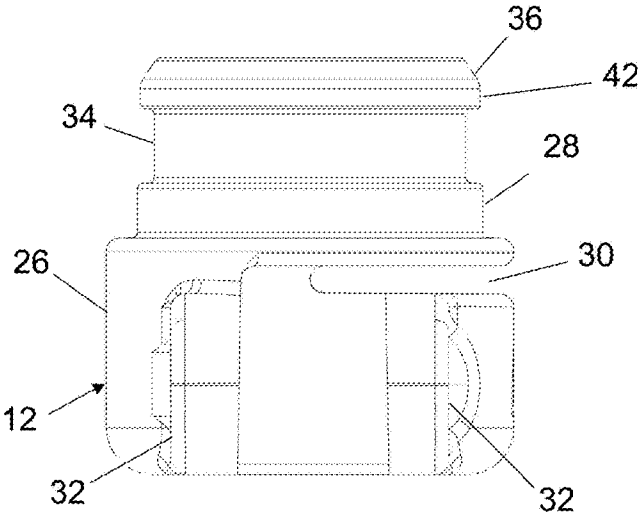
FIGS. 5, 6, 7, and 8 are side, end, top, and cross-sectional views, respectively, of a body member of the clamp assembly of FIGS. 1 through 4.
Figure 5:
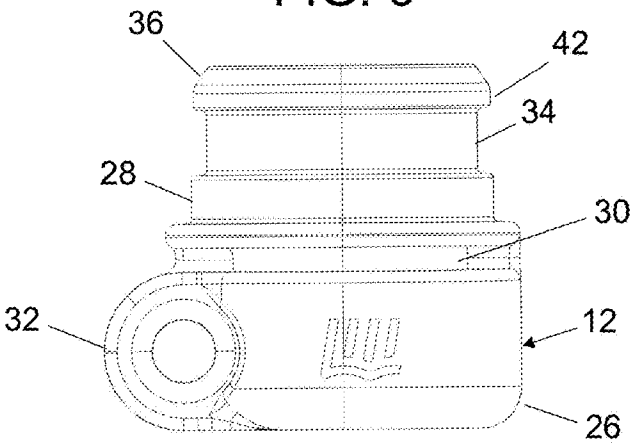
Figure 7:
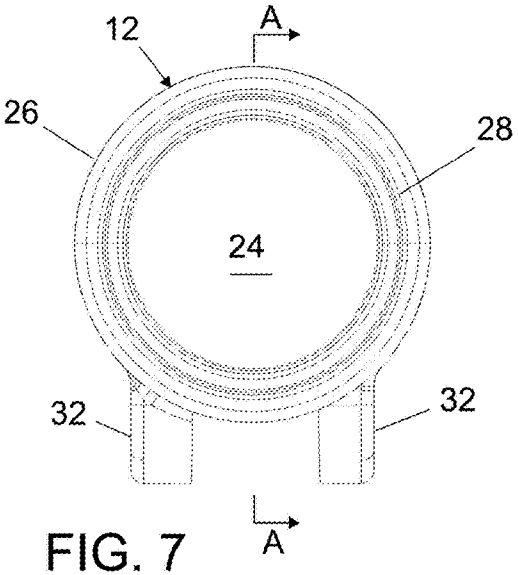
Figure 8:
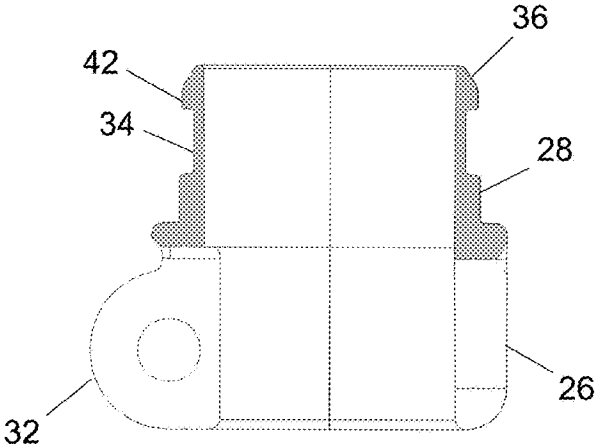
Figure 10:
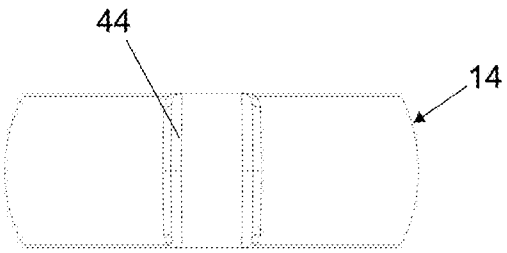
FIGS. 9, 10, 11, and 12 are side, end, top, and cross-sectional views, respectively, of a ring member of the clamp assembly of FIGS. 1 through 4.
Figure 9:
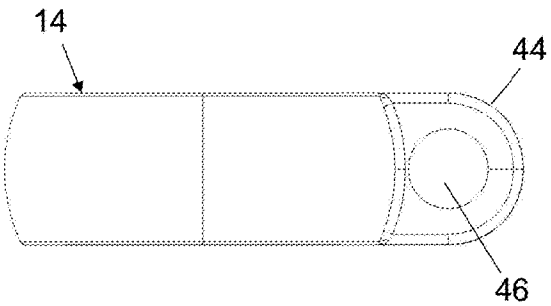
Figure 11:
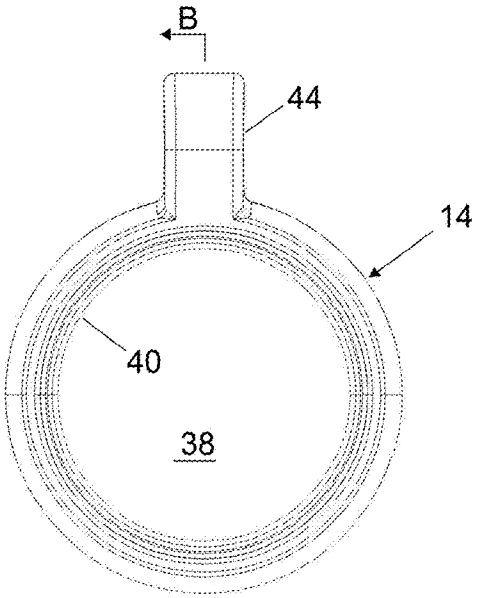
Figure 12:
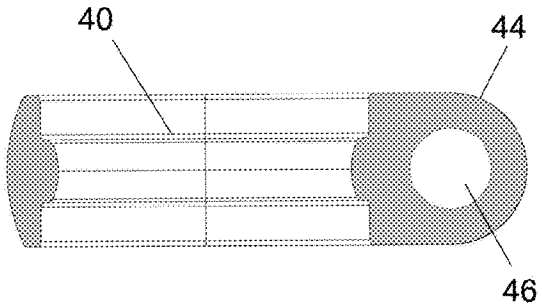
Figure 13:
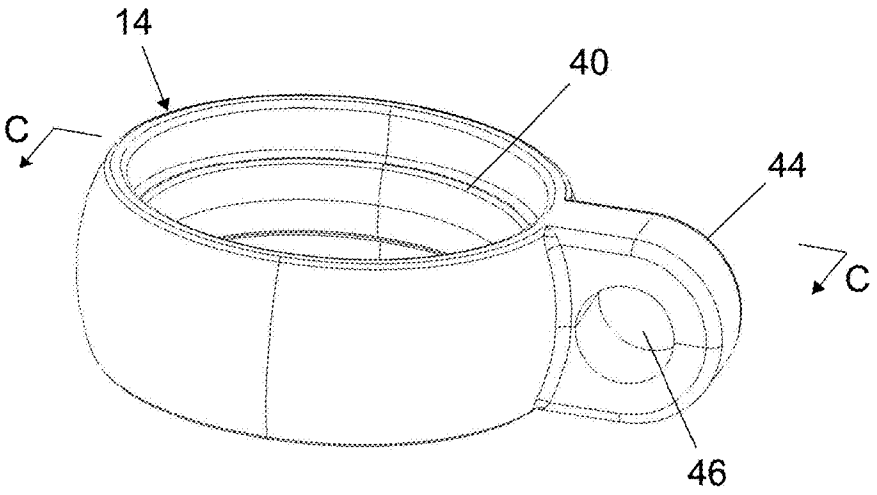
FIGS. 13 and 14 are perspective and cross-sectional perspective views, respectively, of the ring member of FIGS. 9 through 12.
Figure 14:
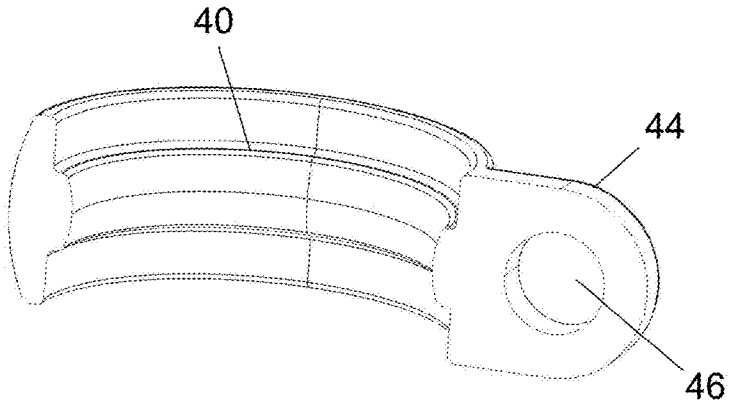

Referring to FIGS. 5 through 8, the body member 12 is represented as having a cavity 24 therethrough along a longitudinal axis thereof. The cavity 24 is shown as having a cylindrical shape consistent with the illustrated embodiment of the clamp assembly 10 being configured to be secured to a fixture having a cylindrical shape and round cross-section. The body member 12 includes a generally C-shaped clamping portion 26 and a ring support portion 28, generally seen as the lower and upper portions, respectively, of the body member 12 as viewed in FIG. 6. The clamping and ring support portions 26 and 28 are interconnected to define a channel 30 therebetween that is disposed in a plane perpendicular to a longitudinal axis of the body member 12 and circumferentially extends around roughly half of the perimeter of the body member 12. The clamping portion 26 has first and second circumferential portions, each circumferentially constituting roughly half of the perimeter of the body member 12. The first circumferential portion of the clamping portion 26 has a continuous perimeter and is integral with the ring support portion 28. The second circumferential portion of the clamping portion 26 is spaced apart from the ring support portion 28 by the channel 30, so as to be cantilevered from the first circumferential portion of the clamping portion 26. Each of the first and second circumferential portions of the clamping portion 26 comprise a flange 32, with the flanges 32 being arranged to be circumferentially spaced apart (FIG. 7) to define a circumferential opening therebetween (FIG. 6).

The flanges 32 protrude outward from the body member 12 (FIG. 7), and each flange 32 includes a through-hole (FIGS. 5 and 8) configured to receive the screw 20. After the screw 20 has been inserted through the holes of the flanges 32, the nut 22 can be threaded onto the screw 20 to retain the screw 20 on the body member 12. Further threading of the nut 22 along the screw shank forces the pair of flanges 32 toward each other, causing the second circumferential portion of the clamping portion 26 to deflect inward and decrease the inner diameter of the clamping portion 26. As such, tightening the screw 20 and nut 22 provides the capability of applying a compressive clamping force to a fixture with the body member 12, thereby releasably securing the body member 12 to the fixture. By creating a sufficient clamping force, the body member 12 can be prevented or at least inhibited from moving along the axial length of the fixture. Loosening the screw 20 and nut 22 reduces or removes the compressive clamping force, thereby releasing the body member 12 from the fixture to permit its movement along the axial length of the fixture. Preferably, the second circumferential portion of the clamping portion 26 is capable of elastically deflecting such that the pair of flanges 32 are capable of contacting each other, establishing a minimum inner diameter for the clamping portion 26.

As an alternative to the above, it is foreseeable and within the scope of the invention that the clamping portion 26 may be operated with a tightening means other than the screw 20 and nut 22. For example, the screw 20 and nut 22 could be replaced with a spline clamp structure, or the second circumferential portion of the clamping portion 26 could be a separate component that is secured to the first circumferential portion with a pair of fasteners.

The ring support portion 28 is configured to be inserted into the ring member 14 and mated therewith to releasably secure the ring member 14 to the body member 12. The ring support portion 28 includes a generally cylindrical body with a recess 34 extending circumferentially about the perimeter of the ring support portion 28. A distal end of the ring support portion 28 oppositely disposed from the clamping portion 26 may be tapered on an exterior edge 36 thereof to promote the ease of insertion into the ring member 14.

Referring to FIGS. 9 through 14, the ring member 14 includes a generally cylindrical body with a generally cylindrical cavity 38 therethrough along a longitudinal axis thereof. Interior surfaces of the ring member 14 include a protrusion 40 extending radially inward about a perimeter thereof that is configured to be received within the recess 34 of the ring support portion 28. Preferably, the protrusion 40 has an inner diameter that is smaller than the outer diameters of an outer surface 42 of the ring support portion 28 between the exterior edge 36 and the recess 34, and the ring member 14 is capable of elastically expanding such that the protrusion 40 may be located over and past the outer exterior surface 42 of the ring support section, received within the recess 34 thereof, and retained therein by walls of the recess 34.

According to one aspect of the invention, the ring support portion 28 and the ring member 14 are configured such that when assembled the ring member 14 is capable of free rotation about the ring support portion 28, preferably entirely around the ring support portion 28 (i.e., 360-degree rotation). A flange 44 protrudes outward from an exterior side of the ring member 14 and includes a through-hole 46 having a center axis perpendicular to the longitudinal axis of the body member 12.

Figure 16:
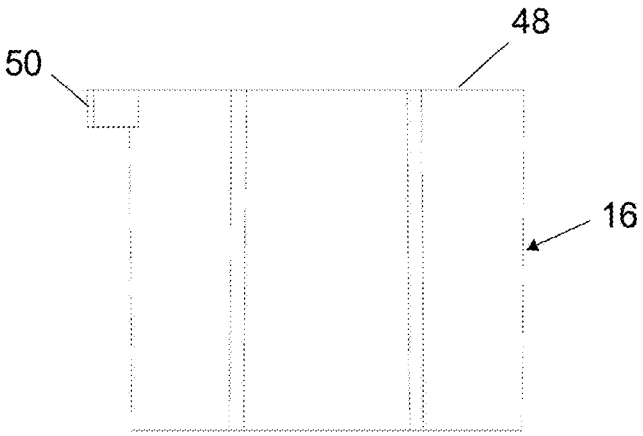
FIGS. 15, 16, and 17 are perspective, side, and top views, respectively, of an insert of the clamp assembly of FIGS. 1 through 4.
Figure 15:
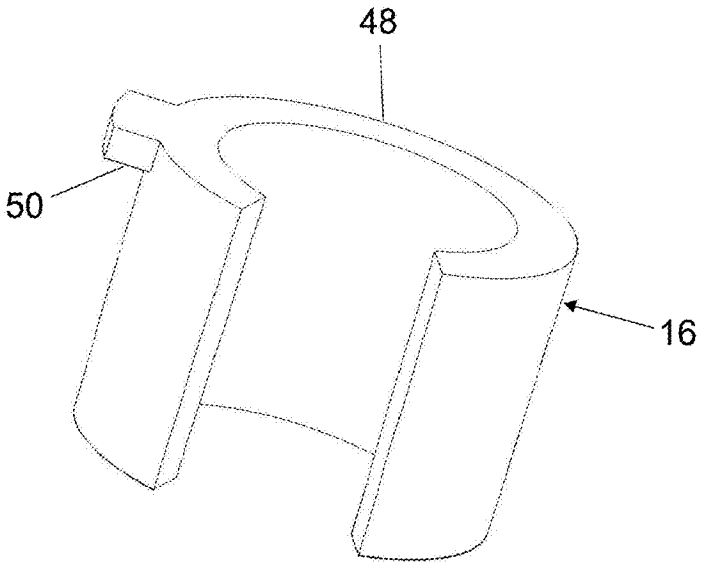
Figure 17:
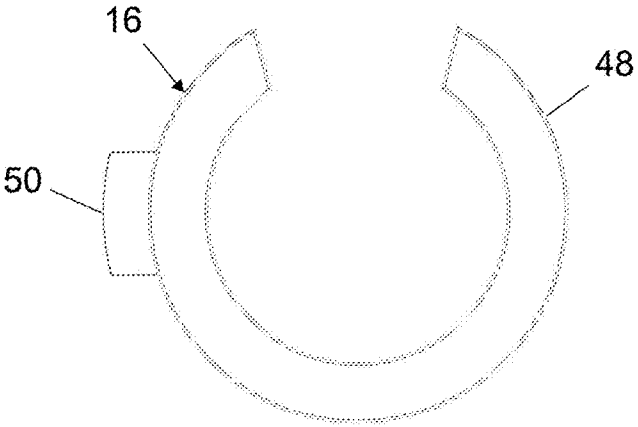

Referring to FIGS. 15 through 17, the insert 16 includes a cylindrical, C-shaped body 48 with a tab 50 protruding outwardly adjacent an end thereof. The insert 16 is configured to be received within cavity 24 of the body member 12 adjacent interior surfaces of the clamping portion 26 with the tab 50 located within the channel 30 between the ring support portion 28 and the clamping portion 26. Location of the tab 50 within the channel 30 reduces the likelihood that the insert 16 will unintentionally move in directions along the longitudinal axis of the body member 12 since the tab 50 will be retained by adjacent walls of the clamping portion 26 and the ring support portion 28. If necessary, the insert 16 may be inserted into the body member 12 by orienting the tab 50 to pass through the opening in the side of the body member 12 and then rotating the insert 16 about the longitudinal axis of the body member 12 such that the tab 50 is located in the channel 30.

The insert 16 is configured to improve the grip of the clamping portion 26 and allow the body member 12 to be secured to fixtures having an outer diameter that is less than the minimum inner diameter achievable with the clamping portion 26 alone. An opening in the side of the insert 16 allows the insert 16 to elastically deform while the clamping portion 26 is tightened with the screw 20, thereby providing a larger range of achievable inner diameters. It is foreseeable and within the scope of the invention that the clamp assembly may include multiple inserts 16 of varying thickness which may be selectively used with the body member 12 to secure the clamp assembly 10 to fixtures of various diameters. It is also foreseeable that the clamp assembly 10 may be used without the insert 16.

Figure 19:
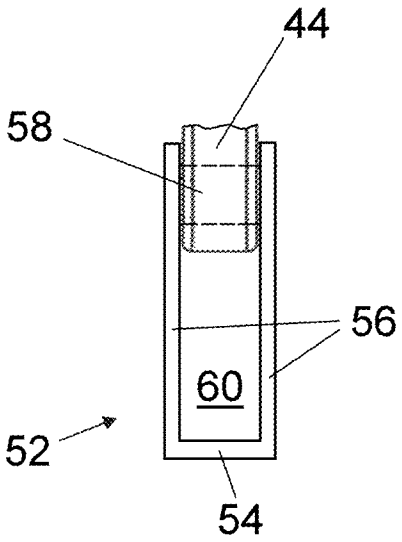
FIGS. 18 and 19 represent, respectively, a side view of a modified ring member and a fragmentary top view of the ring member of FIG. 18 assembled with an adapter in accordance with certain nonlimiting aspects of the invention.
Figure 20:
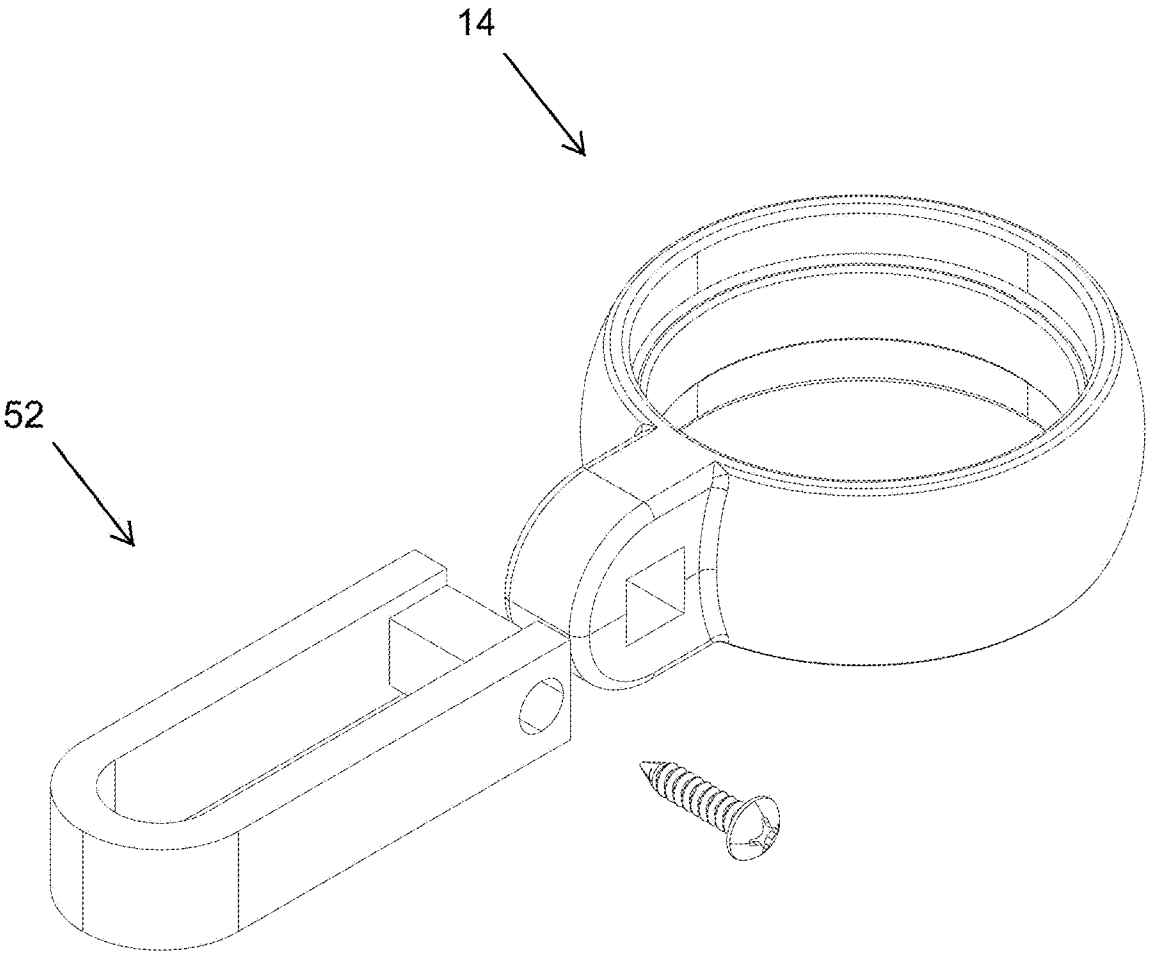
FIG. 20 is an exploded view of the modified ring member and adapter of FIGS. 18 and 19.
Figure 21:
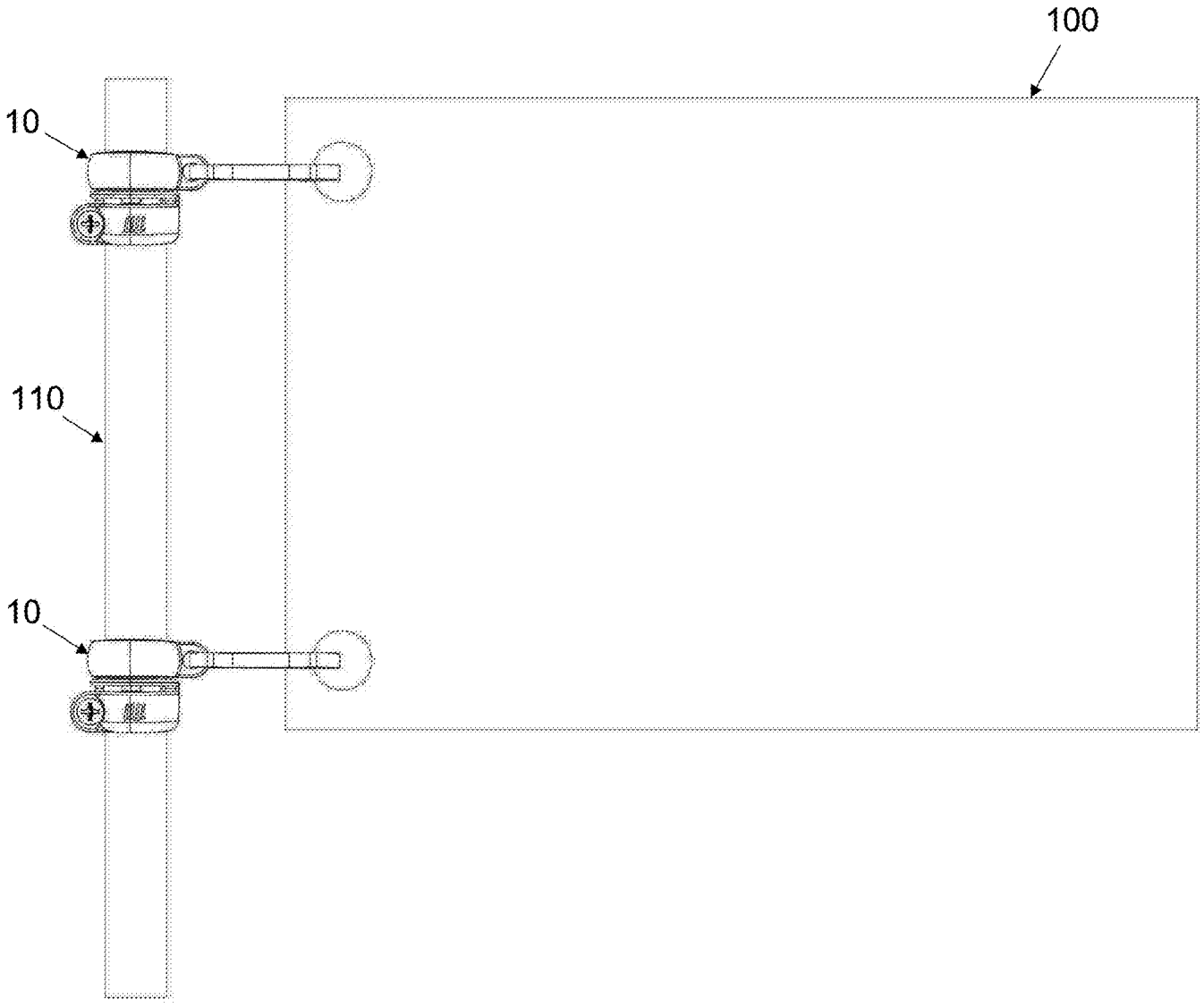
FIG. 21 represents a flag secured to a flag pole with a pair of clamp assemblies of the type represented in FIGS. 1 through 4.

FIGS. 18, 19, and 20 represent a modified version of the ring member 14 whose through-hole 46 has a square- or rectangular-shaped cross-section. FIG. 19 shows an adapter 52 assembled with the flange 44 of the ring member 14 so as to extend radially outward from the ring member 14, essentially as an extension of the flange 44. The adapter 52 has a base 54 and first and second legs 56 that extend in parallel from the base 54. A post 58 extends from the first leg 56 generally perpendicular to the legs 56. The post 58 is complementarily sized and shaped to be received in the through-hole 46 of the ring member 14 to prevent rotation of the post 58 within the through-hole 46 of the flange 44, and therefore prevent rotation of the adapter 52 relative to the ring member 14. The legs 56 are sufficiently flexible to enable a grommet of a flag (or other object) to be inserted into a passage 60 defined by and between the base 54 and legs 56, such that the adapter 52 is able to take the place of the clip 18 depicted in FIGS. 1 through 4. The passage 60 has a central axis that, when the ring member 14 is assembled to the body member 12, is parallel to the longitudinal axis of the body member 12. As represented in FIG. 21, the adapter 52 can be secured to the flange 44 of the ring member 14 with a fastener inserted through an opening in the second leg 56 and threaded into the post 58 of the first leg 56.

Once the various components have been assembled, the clamp assembly 10 may be secured to a fixture and used alone or in combination with other clamp assemblies 10 to releasably secure an object to the fixture. As previously noted, FIG. 21 discloses a nonlimiting example wherein two clamp assemblies 10 are used to secure a flag 100 to a flag pole 110. The components may be formed of various materials including but not limited to metallic materials, polymeric materials, or combinations thereof.

While the invention has been described in terms of a specific embodiment, it is apparent that other forms could be adopted by one skilled in the art. For example, the clamp assembly 10 and its components could differ in appearance and construction from the embodiment described herein and shown in the drawings, and various materials could be used in the manufacturing of the clamp assembly and its components. Accordingly, it should be understood that the invention is not necessarily limited to any embodiment described herein or illustrated in the drawings. It should also be understood that the phraseology and terminology employed above are for the purpose of describing the disclosed embodiment, and do not necessarily serve as limitations to the scope of the invention. Therefore, the scope of the invention is to be limited only by the following claims.

The invention claimed is:

1. A clamp assembly comprising:

a body member having a cavity therethrough configured to receive a fixture, the cavity having a longitudinal axis through a center thereof, the body having a ring support portion and a clamping portion, the clamping portion configured to apply a compressive force to the fixture and thereby releasably secure the body member to the fixture; and a ring member having a cavity therethrough, the ring member secured to the ring support portion of the body member with the ring support portion inserted into the cavity of the ring member in a manner such that the ring member is capable of 360-degree rotation about the ring support member and the longitudinal axis of the cavity of the body member while the body member remains in a fixed position, the ring member having a flange extending outwardly from a side thereof, the flange having a hole therethrough with a central axis that is perpendicular to the longitudinal axis of the body member.

2. The clamp assembly of claim 1, further comprising an adapter assembled to the flange of the ring member, the adapter having a post received in the hole of the flange to prevent rotation of the adapter relative to the ring member, the adapter having a passage therethrough with a central axis that is parallel to the longitudinal axis of the body member.

3. The clamp assembly of claim 1, wherein the clamping portion includes a pair of flanges having axially aligned through holes, a screw located through the holes, and a nut threadably coupled to an end of a shank of the screw such that the screw is retained on the body member with the flanges located between the nut and a head of the screw, wherein threading the nut along the shank of the screw causes the flanges to move toward one another resulting in elastic deflection of at least part of the clamping portion and a decrease in an inner diameter of the cavity of the body member adjacent the clamping portion.

4. A method of using the clamp assembly of claim 3, the method comprising:

locating the fixture through the cavity of the body member;

threading the nut along the shank of and toward the head of the screw such that the flanges of the clamping portion move toward one another until the clamping portion applies a compressive clamping force to the fixture sufficient to retain the clamp assembly in a fixed position on the fixture; and securing an object to the hole in the flange of the ring member such that the object is secured to the fixture and capable of rotating 360 degrees about a longitudinal axis of the fixture.

5. The clamp assembly of claim 1, wherein the cavity of the ring member is configured to be located over the ring support portion of the body member and be secured thereto.

6. The clamp assembly of claim 5, wherein the ring member includes a protrusion extending inwardly from internal surfaces within the cavity of the ring member that is configured to be received and retained within a recess located on exterior surfaces of the ring support portion.

7. The clamp assembly of claim 6, wherein the protrusion circumferentially extends along an entire inner perimeter of the ring member and the recess circumferentially extends along an entire outer perimeter of the ring support portion.

8. The clamp assembly of claim 7, wherein the protrusion has an inner diameter that is smaller than an outer diameter of an exterior surface of the ring support portion, and the ring member is configured to elastically expand such that during assembly the ring support portion may be inserted into the cavity of the ring member such that the protrusion passes the exterior surfaces of the ring support portion and is received within the recess.

9. The clamp assembly of claim 1, further including an insert configured to be located within the cavity of the body member adjacent internal surfaces of the clamping portion.

10. The clamp assembly of claim 9, wherein the insert includes a tab protruding outwardly from a side of the insert, and the body member includes a channel configured to receive the tab and thereby releasably retain the insert within the cavity of the body member.

11. The clamp assembly of claim 10, wherein the channel extends circumferentially about part of the perimeter of the body member and separates a portion of the clamping portion form a second portion of the body member.

12. The clamp assembly of claim 11, wherein the clamping portion includes a pair of flanges having axially aligned through holes, a screw located through the holes, and a nut threadably coupled to an end of a shank of the screw such that the screw is retained on the body member with the flanges located between the nut and a head of the screw, wherein threading the nut along the shank of the screw causes the flanges to move toward one another resulting in elastic deflection of at least part of the clamping portion and a decrease in an inner diameter of the cavity of the body member adjacent the clamping portion, and wherein the channel is connected to an opening in a side of the body member that separates the flanges.

13. A method of assembling the clamp assembly of claim 1, the method comprising:

inserting the ring support portion of the body member into a cavity of the ring member such that a protrusion extending inwardly from internal surfaces within the cavity of the ring member passes exterior surfaces of the ring support portion and is received within a recess located on the exterior surfaces of the ring support portion.

14. The method of claim 13, wherein the protrusion circumferentially extends along an entire inner perimeter of the ring member and the recess circumferentially extends along an entire outer perimeter of the ring support portion.

15. The method of claim 14, wherein the protrusion has an inner diameter that is smaller than an outer diameter of the exterior surfaces of the ring support portion, and the ring member elastically expands as the ring support portion is inserted into the cavity of the ring member such that the protrusion passes the exterior surfaces of the ring support portion and is received within the recess.

16. A clamp assembly comprising:

a body member having a cavity therethrough configured to receive a fixture, the cavity having a longitudinal axis through a center thereof, the body having a clamping portion configured to apply a compressive force to the fixture and thereby releasably secure the body member to the fixture;

a ring member secured to the body member in a manner such that the ring member is capable of 360-degree rotation about the longitudinal axis of the cavity of the body member while the body member remains in a fixed position, the ring member having a flange extending outwardly from a side thereof, the flange having a hole therethrough with a central axis that is perpendicular to the longitudinal axis of the body member; and an insert configured to be located within the cavity of the body member adjacent internal surfaces of the clamping portion, wherein the insert includes a tab protruding outwardly from a side of the insert, and the body member includes a channel configured to receive the tab and thereby releasably retain the insert within the cavity of the body member.

17. The clamp assembly of claim 16, wherein the channel extends circumferentially about part of the perimeter of the body member and separates a portion of the clamping portion form a second portion of the body member.

18. The clamp assembly of claim 17, wherein the clamping portion includes a pair of flanges having axially aligned through holes, a screw located through the holes, and a nut threadably coupled to an end of a shank of the screw such that the screw is retained on the body member with the flanges located between the nut and a head of the screw, wherein threading the nut along the shank of the screw causes the flanges to move toward one another resulting in elastic deflection of at least part of the clamping portion and a decrease in an inner diameter of the cavity of the body member adjacent the clamping portion, and wherein the channel is connected to an opening in a side of the body member that separates the flanges.

* * * * *